United States Patent [19]

Reiser et al.

[11] 4,119,035

[45] Oct. 10, 1978

[54] PRINTING PLATE

[75] Inventors: Kurt Reiser; Paul Abendroth, both of Offenbach am Main, Fed. Rep. of Germany

[73] Assignee: Roland Offsetmaschinenfabrik Faber & Schleicher AG., Fed. Rep. of Germany

[21] Appl. No.: 844,906

[22] Filed: Oct. 25, 1977

[30] Foreign Application Priority Data

Oct. 28, 1976 [DE] Fed. Rep. of Germany ..... 2649011

[51] Int. Cl.[2] ..... B41H 1/08

[52] U.S. Cl. ..... 101/459; 101/401.1

[58] Field of Search ..... 101/458, 459, 401.1

[56] References Cited

U.S. PATENT DOCUMENTS

| | | | |
|---|---|---|---|
| 13,587 | 9/1855 | Lowe | 101/458 |
| 956,764 | 5/1910 | Gerb | 101/459 |
| 1,069,857 | 8/1913 | Cornwall | 101/459 |
| 1,680,097 | 8/1928 | Eaton | 101/395 |
| 1,811,734 | 6/1931 | Trist | 101/458 |
| 2,181,111 | 11/1939 | Horn | 101/459 |
| 2,291,854 | 8/1942 | Whyzmuzis | 101/459 |

*Primary Examiner*—Clyde I. Coughenour

*Attorney, Agent, or Firm*—Leydig, Voit, Osann, Mayer & Holt, Ltd.

[57] ABSTRACT

A flexible metal printing plate for a lithographic printing press made up of a sheet of iron having a thin adherent top layer of a metal more noble than iron and having a thin layer of sacrificial metal conductively bonded to the underside of the iron sheet, the sacrificial metal being less noble than iron as determined by its position above iron in the electromotive series, the preferred sacrificial metal being zinc.

1 Claim, 1 Drawing Figure

1 Fe

2 Cu

3 Cr

4 Zn

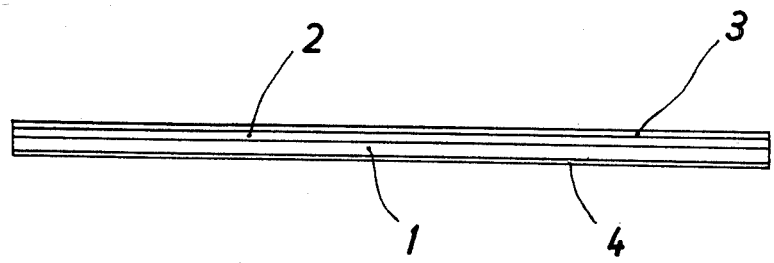
1 Fe
2 Cu
3 Cr
4 Zn

PRINTING PLATE

A conventional flexible printing plate for a lithographic printing press is commonly formed by a base layer of iron, or of an alloy consisting predominantly of iron, with the superimposed thin layers of copper and chromium.

It is found that during the course of manufacture copper and chromium residues may be unwantedly deposited on the reverse, or underside, of the plate. When a plate having adherent copper or chromium residues on the underside is mounted upon a plate cylinder it is found that the cylinder is etched or corroded in the region of the residue. Observation shows that such etching or corrosion is due to the presence of casual moisture having dissolved therein traces of the plate and cylinder cleaning agent which acts as an electrolyte.

It is, accordingly, an object of the present invention to provide an improved plate, which has, bonded to the underside, a layer of metal which is above iron in the electromotive series.

It is a more specific object to provide a flexible metal printing plate, made of iron but having noble metal residues on the back side which is provided with a bonded protective layer of zinc which not only shields the noble metal residue from contact with the plate cylinder but which serves sacrificially to etch or corrode in the face of galvanic action leaving the surface of the printing cylinder bright and unaffected.

It is therefore a general object of the invention to provide a printing plate construction which cannot possibly act to corrode the plate cylinder and which therefore extends indefinitely the life and appearance of the plate cylinder.

Other objects and advantages of the invention will become apparent upon reading the attached detailed description and upon reference to the drawing which shows, in enlarged section, a printing plate constructed in accordance with the invention.

While the invention has been described in connection with a preferred embodiment, it will be understood that we do not intend to be limited to the particular embodiment shown but intend, on the contrary, to cover the various alternative and equivalent forms of the invention as set forth in the appended claims.

Experience has shown that when using conventional lithograph plates of flexible metal having an iron base layer the surface of the printing cylinder on which such plates are mounted over a period of time becomes locally etched or corroded, and hence unsightly, but the reason for such deterioration has not been generally appreciated.

Our studies and observations show that such corrosion or etching results from galvanic action by reason of imperfections in the plate. Specifically, a flexible plate, such plate having an iron base layer and which is topped in the conventional way with layers of copper and chromium, will, as a result of manufacture have a certain amount of copper and chromium residue on the underside, usually in an amount which may pass unnoticed. When the plate is installed on a printing cylinder in intimate metallic contact, the patches, or residue, of copper and chromium, in the presence of casual moisture combined with traces of cleaning agent, will cause a galvanic couple to be set up in which the copper or chromium form the positive pole and the adjacent area of the cylinder forms the negative pole. While the voltage differential may be slight, the large area of metal in surrounding contact reduces the circuit resistance to an extremely low value so appreciable galvanic current may be generated with the result that the surface of the plate cylinder is eaten away, soon becoming unsightly.

We have found that this problem can be easily, cheaply and completely solved by bonding to the underside of the plate an overall layer of zinc which may be done either by electroplating or by galvanizing.

Such layer of zinc performs a dual function. In the first place, it seals the residual copper or chromium against direct metallic contact with the surface of the plate cylinder. Secondly, in the event that there is any battery action by reason of imperfections in the zinc coating, the zinc serves as a sacrificial layer, suffering any etching which may occur, and leaving the surface of the printing cylinder bright, clean, and unaffected.

As shown in the attached drawing, the base layer indicated at 1 is of iron or a soft alloy consisting predominantly of iron. The iron is covered with a layer of copper 2 to which is applied a layer of chromium 3, the functions of the copper and chromium being well understood in the art of lithographic printing. The invention comprises the improvement of bonding to the underside of the plate a thin layer 4 of zinc, as shown. The result is to produce a composite plate preferably having a total of four layers.

The cost of adding the layer of zinc or equivalent forms an inconsequential element in the price of the total plate while positively and indefinitely preserving the surface of the cylinder upon which such plate is mounted.

What we claim is:

1. A flexible metal printing plate for clamping to the surface of a plate cylinder in a printing press in the presence of casual moisture plus traces of a plate and cylinder cleaning agent forming an electrolyte trapped in between comprising, in combination, a base layer of iron, a noble metal printing layer consisting of a layer of copper bonded to the top surface of the base layer and a layer of chromium bonded to the top surface of the copper with the bonding thereof resulting in noble metal residue on the under surface of the base layer, and a layer of zinc conductively bonded to the under surface of the base layer completely covering the same including the residue thereby to protect the surface of the cylinder in the presence of electrolyte from galvanic action by the residue.

* * * * *